US006557510B2

(12) United States Patent
Sjovall et al.

(10) Patent No.: US 6,557,510 B2
(45) Date of Patent: May 6, 2003

(54) INTERNAL COMBUSTION ENGINE COMPRESSION REDUCTION SYSTEM

(75) Inventors: Scott A. Sjovall, Westby, WI (US); Floyd I. Baker, Readstown, WI (US); Steven A. Kensok, Viroqua, WI (US); Dan Kinsey, Lafarge, WI (US); Steven W. Svacina, Viola, WI (US)

(73) Assignee: S & S Cycle, Inc., Viola, WI (US)

( * ) Notice: Subject to any disclaimer, the term of this patent is extended or adjusted under 35 U.S.C. 154(b) by 0 days.

(21) Appl. No.: 09/776,604

(22) Filed: Feb. 2, 2001

(65) Prior Publication Data

US 2002/0104500 A1 Aug. 8, 2002

(51) Int. Cl.[7] ..... F02D 15/00; F02N 17/08
(52) U.S. Cl. ..... 123/182.1
(58) Field of Search ..... 123/182.1

(56) References Cited

U.S. PATENT DOCUMENTS

| | | | | |
|---|---|---|---|---|
| 3,791,145 A | * | 2/1974 | Yamamoto | 123/182.1 |
| 4,194,485 A | * | 3/1980 | Stephenson | 123/182.1 |
| 4,204,384 A | * | 5/1980 | Holtemann | 123/182.1 |
| 5,325,838 A | | 7/1994 | Bennett | 123/527 |
| 5,375,570 A | * | 12/1994 | Swain | 123/182.1 |
| 5,943,997 A | | 8/1999 | Kinsey et al. | 123/516 |
| 5,957,097 A | | 9/1999 | Schanz | 123/90.17 |
| 5,983,849 A | | 11/1999 | Wangen et al. | 123/90.61 |
| 6,065,457 A | | 5/2000 | Hoffmann et al. | 123/572 |

OTHER PUBLICATIONS

Color photos of "Existing Compression Relief Valves" a cylinder head assembly, 2 pages (Date Unknown).
Hand drawing of existing relief valve, 2 pages (Date Unknown).
Photograph of Compression Release Valve from a 1988 model Yamaha Snowmobile (disassembled).
Photograph of Compression Release Valve from a 1988 model Yamaha Snowmobile (partially assembled).

* cited by examiner

*Primary Examiner*—Andrew M. Dolinar
(74) *Attorney, Agent, or Firm*—Merchant & Gould PC

(57) ABSTRACT

An internal combustion engine includes pressure relief devices that reduce pressure due to compression during startup, thereby decreasing the force needed to start the engine. A pressure relief valve mounts on top of the cylinder head and includes a duct to the combustion chamber leading to the valve and a second duct leading to the exhaust port so that gases in the combustion chamber may be vented through the exhaust system. A mechanical actuator having cables directed to each of the pressure relief valves for each of the cylinders manually actuates a first embodiment. A second embodiment includes a solenoid with wiring tied into a starter circuit that actuates the multiple valves from a single actuator.

22 Claims, 12 Drawing Sheets

INTERNAL COMBUSTION ENGINE COMPRESSION REDUCTION SYSTEM

BACKGROUND OF THE INVENTION

1. Field of the Invention

The present invention is directed to a compression pressure reduction apparatus for an internal combustion engine and to an engine having a pressure relief apparatus to reduce compression pressure during start up and minimize the power needed by the starter motor to crank the engine.

2. Description of the Prior Art

Internal combustion engines must be turned over using battery power to start the engine and have ignition occur. During the start up phase, the pistons moving up in the cylinders create a compression pressure that must be overcome in order to crank the engine. This compression pressure creates additional forces during start up and a greater drain on the battery and stress to the starter motor and other components.

Devices are known that reduce the compression pressure in internal combustion engines during start up. However, these devices suffer from several undesirable attributes that make them less efficient and impractical. Some devices vent gases to the atmosphere during startup to relieve compression pressure. However, such devices do not provide proper filtering or muffling of these gases. Such gases typically contain unburned fuel, oil and other airborne contaminants and the engine surfaces may acquire a residue from the venting of these gases during start up. Such a condition is messy and makes the engines less attractive. Some devices do not provide remote actuation, making access to these devices difficult for the operator.

U.S. Pat. No. 5,957,097 discloses an internal combustion engine with automatic compression relief. The compression relief system uses the existing valves of each cylinder and a special camshaft. The camshaft has cams that engage the valves and keep them in a partially open position. At higher pressures, biasing forces from springs are overcome to disengage the cams, so the valves return to their normal operating position. Such a device requires an expensive modified camshaft and is quite complicated. The camshaft cannot be manually selectively activated.

It can be seen then that a new and improved compression pressure reduction system is needed that overcomes the problems associated with the prior art. Such a compression pressure reduction system should be easily actuated and should vent gases to the exhaust system. Moreover, such a device should provide valving to a plurality of cylinders with actuation from a single source. Such a device should use existing cams and cylinder valves and be easily mounted to the engine. The present invention addresses these as well as other problems associated with the prior art.

SUMMARY OF THE INVENTION

The present invention relates to a compression pressure reduction device for an internal combustion engine, and more particularly, to a pressure relief device to reduce pressure from compression during startup.

An internal combustion engine of the present invention includes a cylinder head with a compression relief valve connected by a duct to the combustion chamber. The pressure relief valve associated with each cylinder threadably mounts in a bore on the top of the cylinder head. A duct leads from the combustion chamber at the top of the cylinder to the pressure relief valve. A second duct leads from the bore to the exhaust port of the cylinder head. In this manner, gases that may include unburned fuel and oil are directed through the exhaust system, rather than being vented to the atmosphere. Each cylinder has an associated pressure relief valve and all the relief valves are actuated from a single actuator in preferred embodiments.

In a first embodiment of the present invention, the pressure relief valve is mechanically actuated and includes a valve body with a plunger in an axial bore formed in the valve body. The valve body includes exit holes aligned with the duct to the exhaust port so that when the plunger is open, gases may vent through the valve body to the exhaust port. The plunger includes a widened end portion with a seating surface that seats against the end of the valve body in a closed position and spaced apart from the valve body in the open position. The valve body mounts to a connector member mounting to a cam housing. The cam housing includes a cam engaging the top of the plunger and pivotally mounting to the cam housing. A cable connects to the cam to pivot the cam to a closed position and push the plunger to an open position. The cable connects with cables from other cylinders to a manually operated remote actuator that has a knob that is pulled to retract the cable and pivot the cam, thereby opening the valve. A spring in the valve biases the plunger toward the closed position. Spring loaded detent bearings engage a recess in the plunger body and hold the plunger in the open position, with the plunger head extended from the valve body.

According to a second embodiment of the present invention, an electrically actuated pressure relief valve mounts in the cylinder head associated with each cylinder. A plunger and body are similar to the mechanically actuated first embodiment and mount in the same manner. In the second embodiment, a solenoid is utilized to actuate the plunger. A solenoid body includes internal integral coils. An iron core extends into the solenoid body within the coil and pushes the plunger to the open position when it is energized. A spring biases the sliding solenoid core toward the closed position. A single actuator may energize wiring leads to the starter or another circuit so that the pressure relief valves associated with the cylinders are actuated together. In addition, if the circuit is tied in with the starter, the solenoid is de-energized and the valve closes when the button is released, so that the valve is only open for the required time.

These features of novelty and various other advantages, which characterize the invention, are pointed out with particularity in the claims annexed hereto and forming a part hereof However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT

Figure 1:
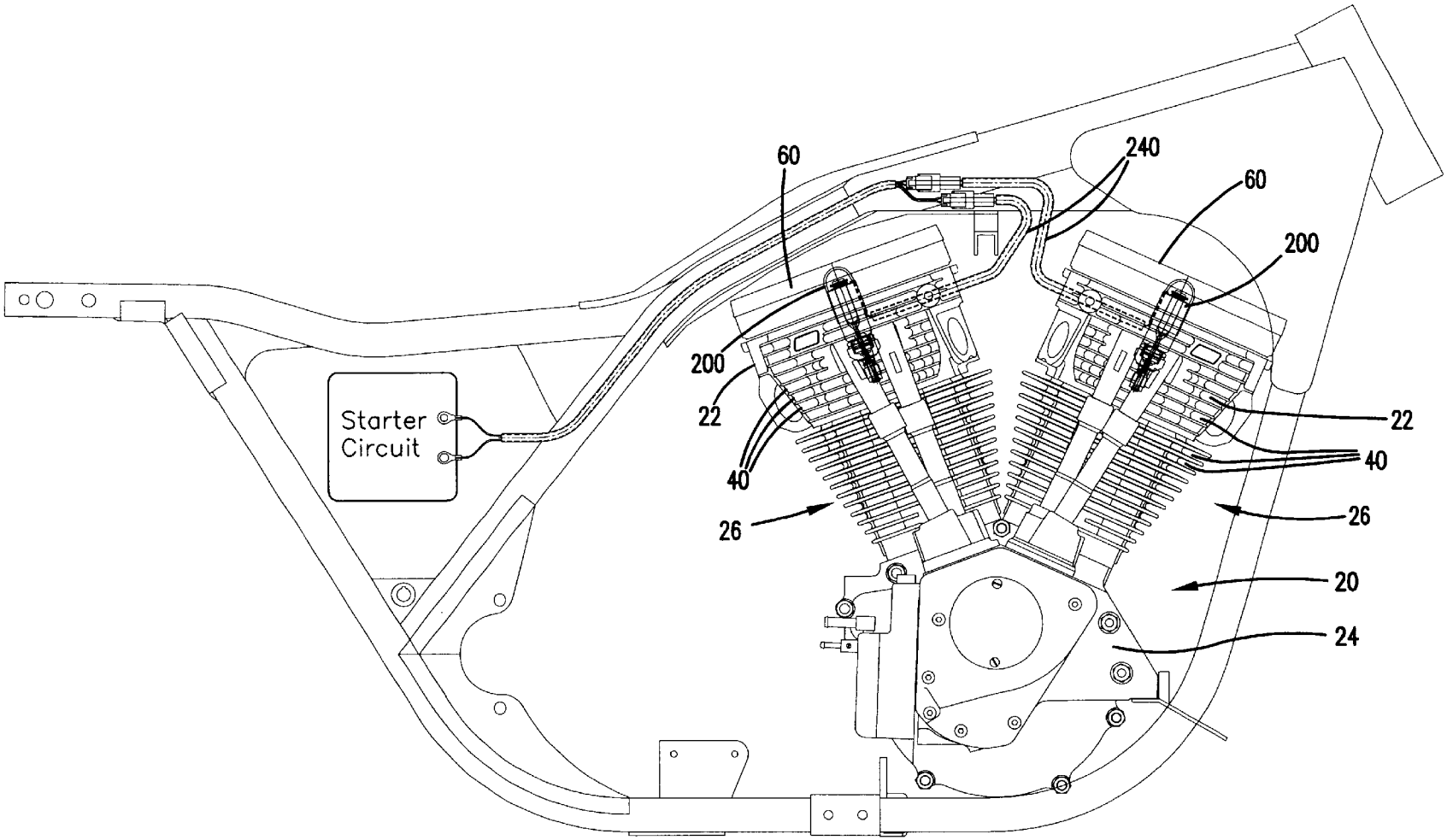
FIG. 1 shows a diagrammatic view of an internal combustion engine with a second embodiment of compression pressure reduction system relief valves according to the principles of the present invention.

Referring now to the drawings, and in particular FIG. 1, there is shown an engine, generally designated 20. The engine 20 is for a motorcycle and includes a crankcase 24 and two cylinders 26 with two associated cylinder heads 22. It can be appreciated that the present invention may be utilized with other internal combustion engines for other uses and that the number of cylinders may vary with the type of engine. A second embodiment of a pressure release valve is generally designated 200. Although the valve 200 is shown, it can be appreciated that another embodiment of a release valve described hereinafter operates to vent in the same manner, but is actuated mechanically rather than electrically.

Figure 2:
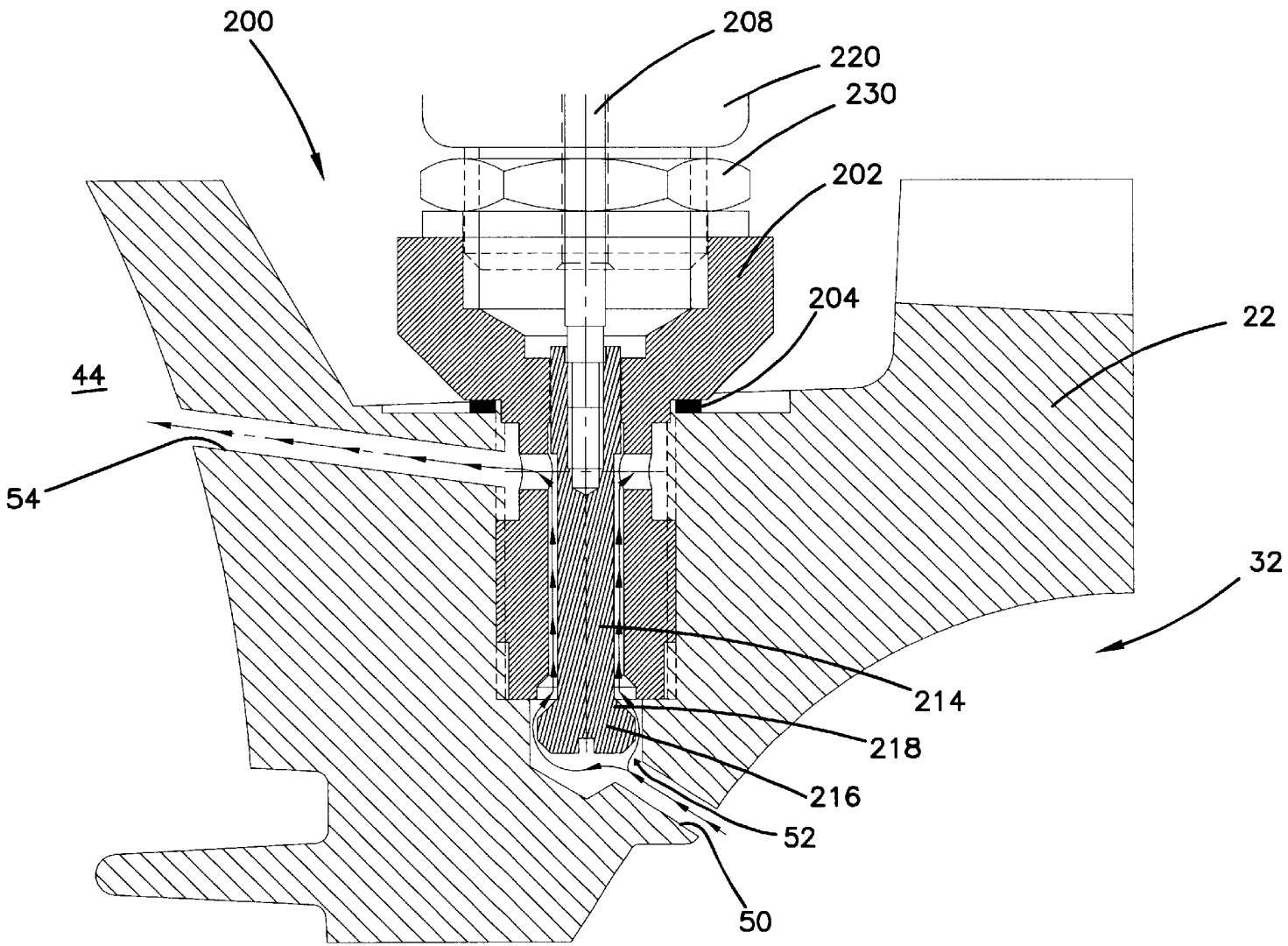
FIG. 2 shows a side sectional view of a portion of a cylinder head with a compression relief valve for the engine shown in FIG. 1 according to the principles of the present invention.
Figure 3:
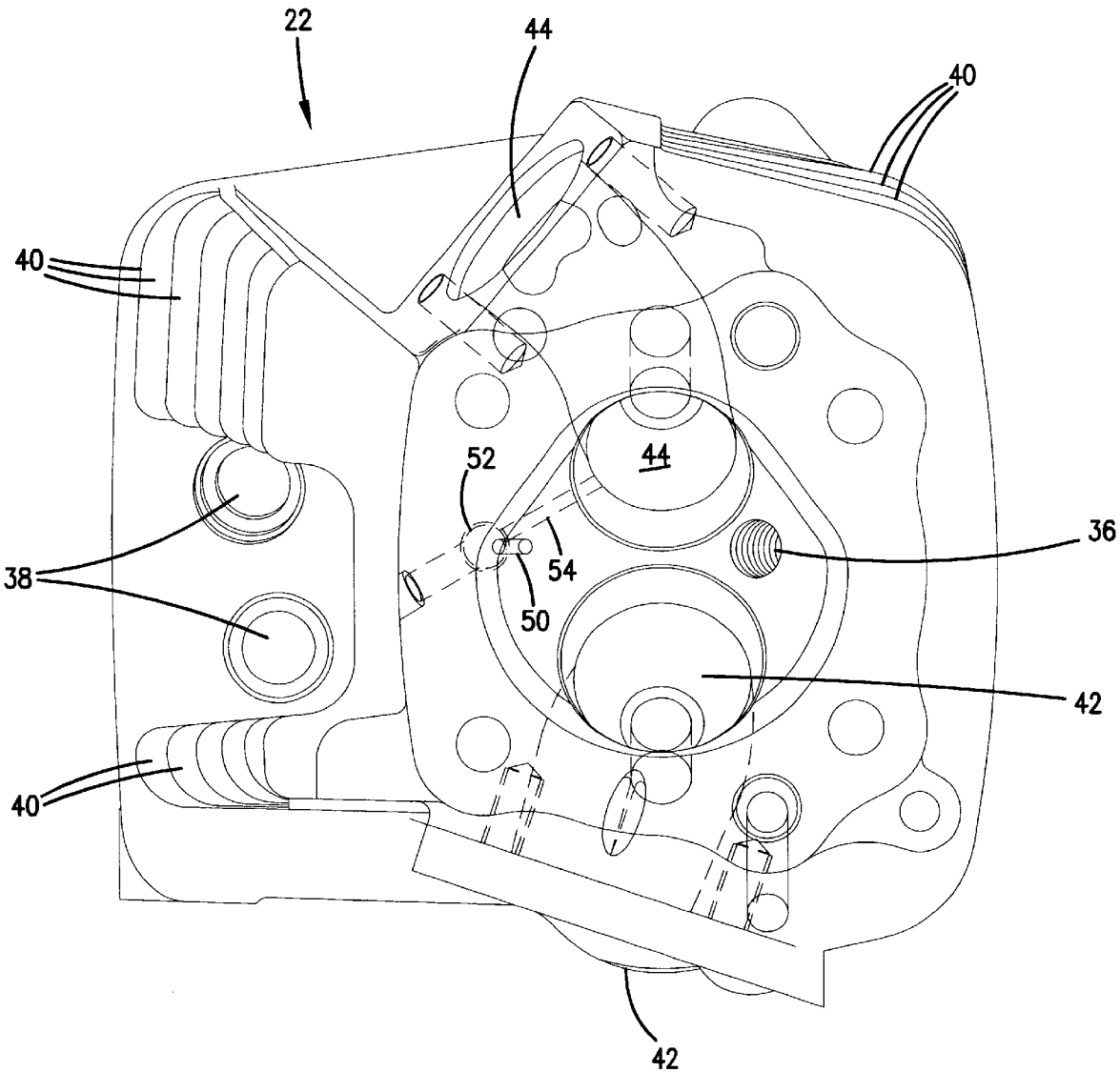
FIG. 3 shows a bottom plan view of a cylinder head with a pressure relief duct according to the principles of the present invention.
Figure 4:
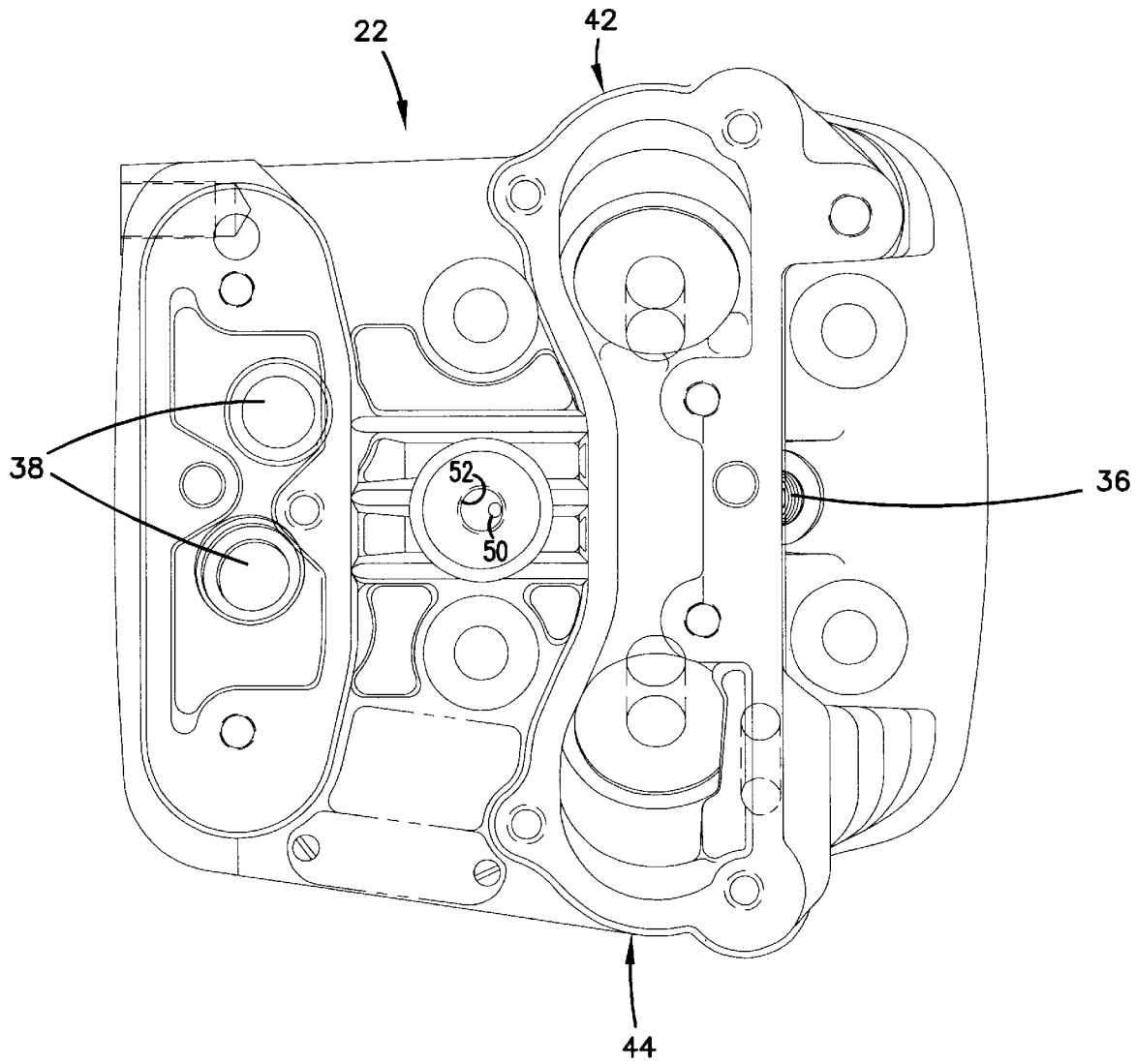
FIG. 4 shows a top plan view of a cylinder head with a pressure relief duct according to the principles of the present invention.
Figure 5:
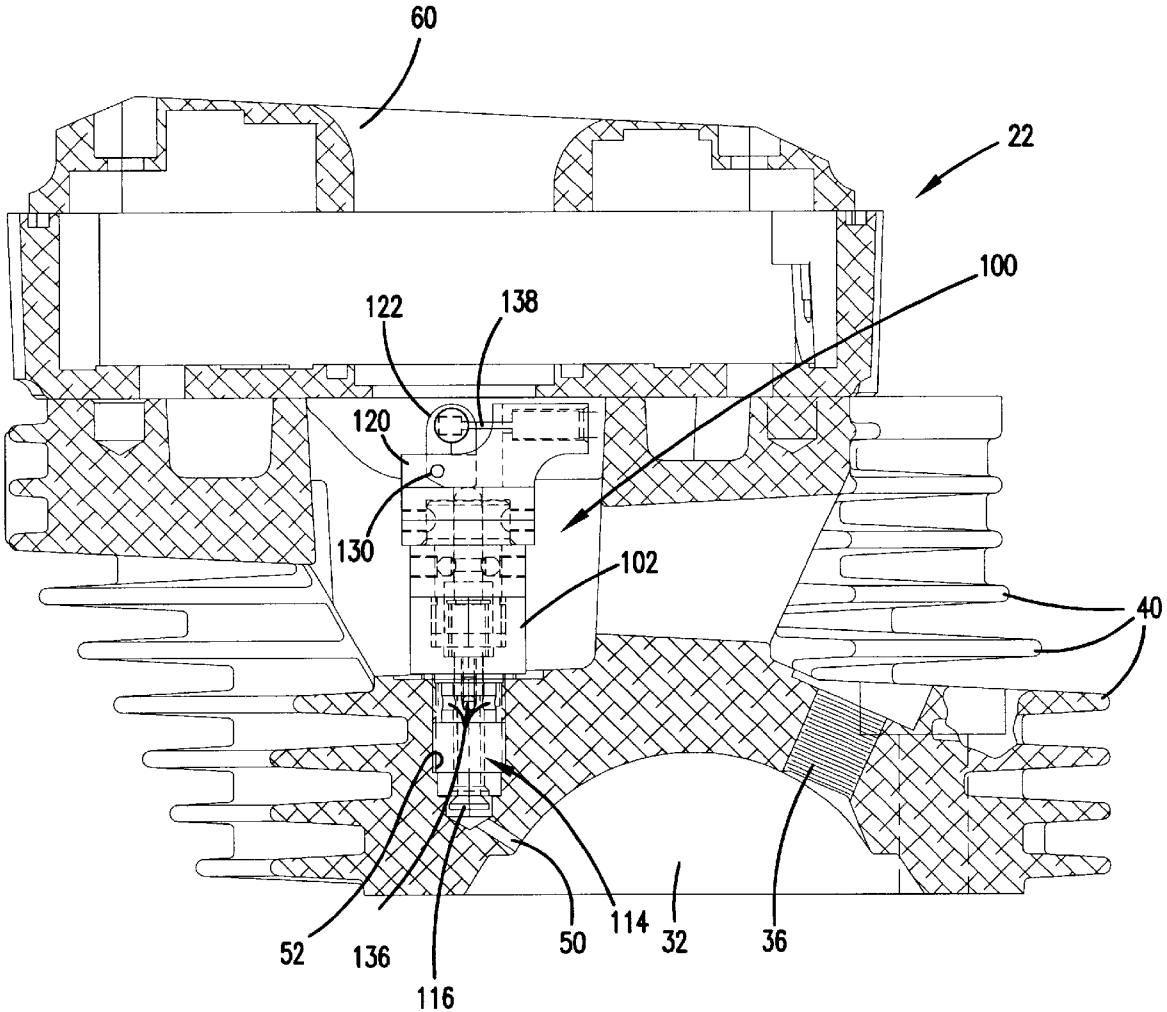
FIG. 5 shows a side sectional view of a cylinder head with a pressure relief duct and a first embodiment of a release valve according to the principles of the present invention.
Figure 6:
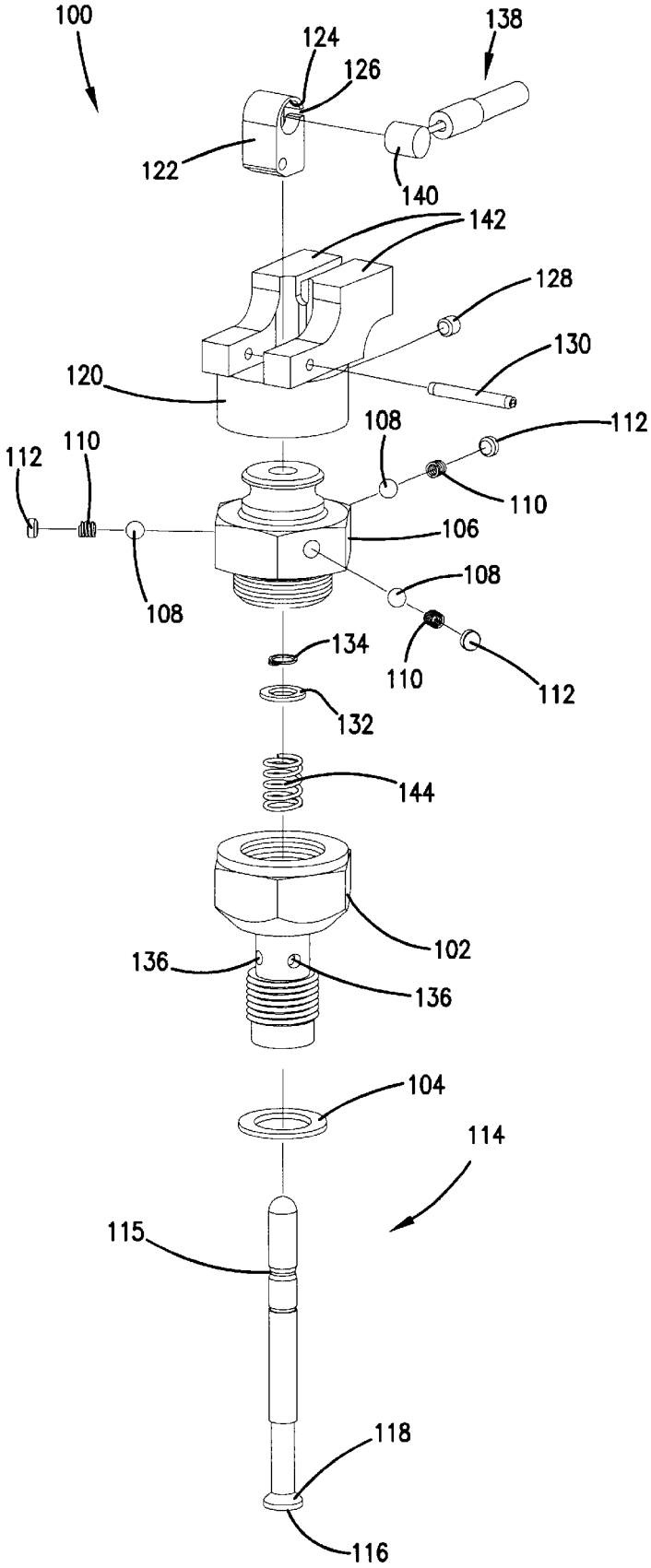
FIG. 6 shows an exploded view of the release valve shown in FIG. 5.

Referring to FIGS. 3, 4 and 5, each cylinder head 22 includes a number of cooling fins 40 extending outward from the cylinder head 22 to increase surface area and utilize air for cooling. A combustion chamber 32 includes a spark plug hole 36 receiving the spark plug for ignition and includes an intake port 42 and an exhaust port 44. A rocker cover 60 mounts above the cylinder head 22. Push rod holes 38 provide for push rods (not shown) extending up to rocker arms (not shown) in the rocker cover 60. As shown in FIG. 5, a release valve 100 mounts at the top of the cylinder head 22 into a mounting bore 52, as explained hereinafter. As shown in FIG. 2, a first relief duct 50 extends to the valve 100 or 200 from the combustion chamber 32. A second relief duct 54 from the bore 52 extends to the exhaust port 44 for reducing the compression pressure and venting gas to the exhaust.

Referring to FIGS. 5–8, there is shown the first embodiment of the release valve 100. The valve 100 includes a valve body 102 with a crush-type compression washer 104 abutting a lower end of the valve body 102 that seats against the bore 52 in the cylinder head 22. The valve body 102 is threaded to mount in complementary internal threads in the bore 52. Three spaced apart ball type bearings 108 are housed in a connector element 106 to retain a plunger. Each of the bearings 108 is biased inward by an associated detent spring 110 and includes an associated plug 112. In the embodiment shown, there are three bearings 108, associated detent springs 110 and plugs 112, however other configurations are also possible.

A plunger 114 includes a widened head 116 with an upper sealing surface 118. Sealing surface 118 of the head engages a complementary sealing surface on the end of the valve body 102 to close the valve 100, as explained hereinafter. The bearings 108 are biased inward and engage an annular recess 115 in the plunger 114 in the open position. The detent ball bearings 108 are pushed into the recess 115 by the springs 110 and provide resistance to movement to the closed position and maintain the plunger 114 in the open position during start up. The valve 100 is actuated by a cam 122 mounted to a cam housing 120 and engaging an upper end of the plunger 114. The upper portion of the cam housing 120 includes a pair of cam cable receiver portions 142 defining a cable guide slot there between. The cam 122 pivots about a pivot pin 130. A set screw 128 threadably mounts to the cam housing 120 and engages the circumferential groove in the top of the connector element 106. This provides for orienting the cables 138 in the proper direction when the valve 100 is mounted. A washer 132 and clip 134 guide and align the plunger 114 toward the correct position. A spring 144 biases the plunger 114 toward the closed position. The valve body 102 includes a section with a reduced diameter aligned with exit holes 136. The exit holes 136 align with the second relief duct 54 to the exhaust port 44. Cable 138 mounts to the cam 122 and includes an end barrel member 140 inserting into a receiver portion 124 and the cam 122. A slot 126 allows the cable 138 to extend outward there from.

Figure 7:
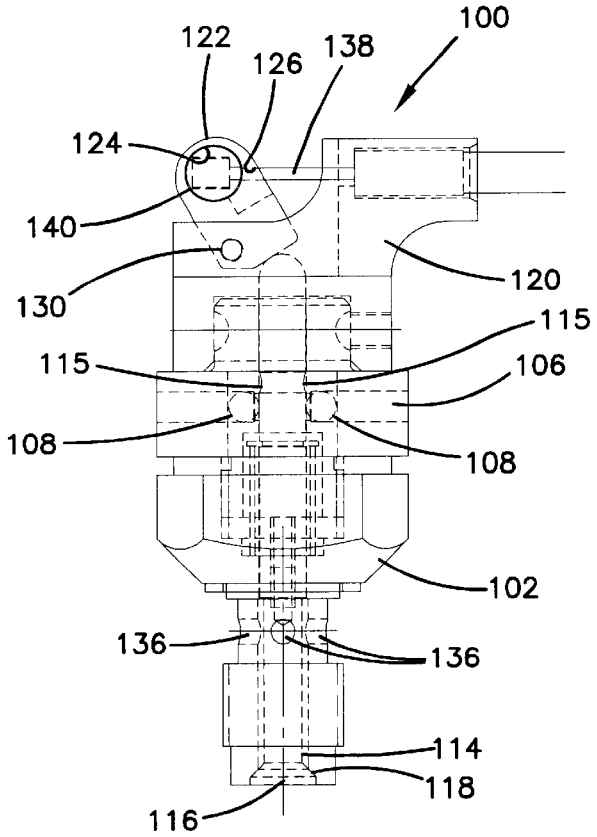
FIG. 7 shows a side elevational view of the valve shown in FIG. 6 in a closed position.
Figure 8:
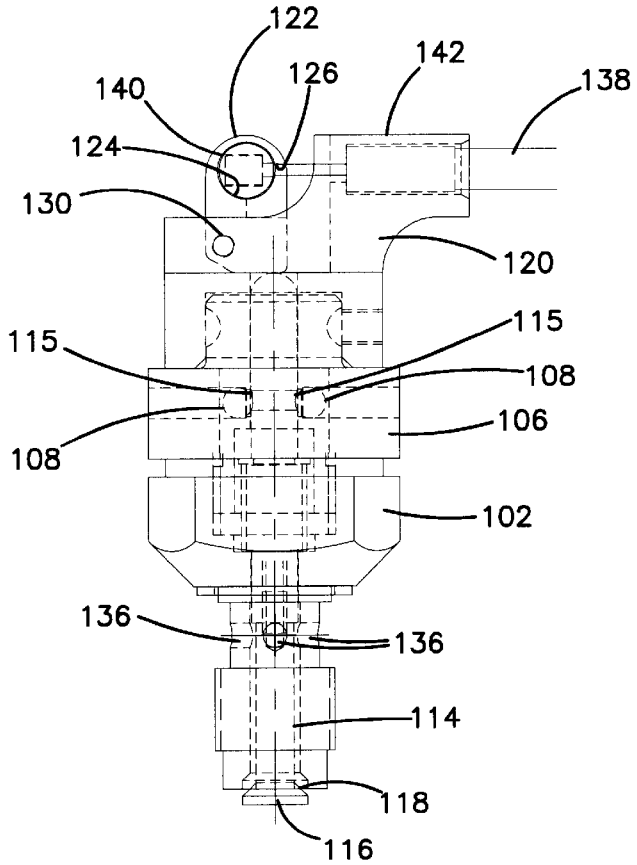
FIG. 8 shows a side elevational view of the valve shown in FIG. 6 in an open position.

The valve 100 moves between the closed position shown in FIG. 7 and the open position shown in FIG. 8. In the closed position, the sealing surface 118 seats against the bottom of the valve body 102. In the open position, the plunger head 116 is extended from and spaced apart from the valve body 102, allowing air to pass through the valve 100 and out the exit holes 136. The cam 122 pivots upward as shown in FIG. 7 when the plunger 114 is raised in response to increased pressure in the cylinder 26, as explained hereinafter.

Figure 9:
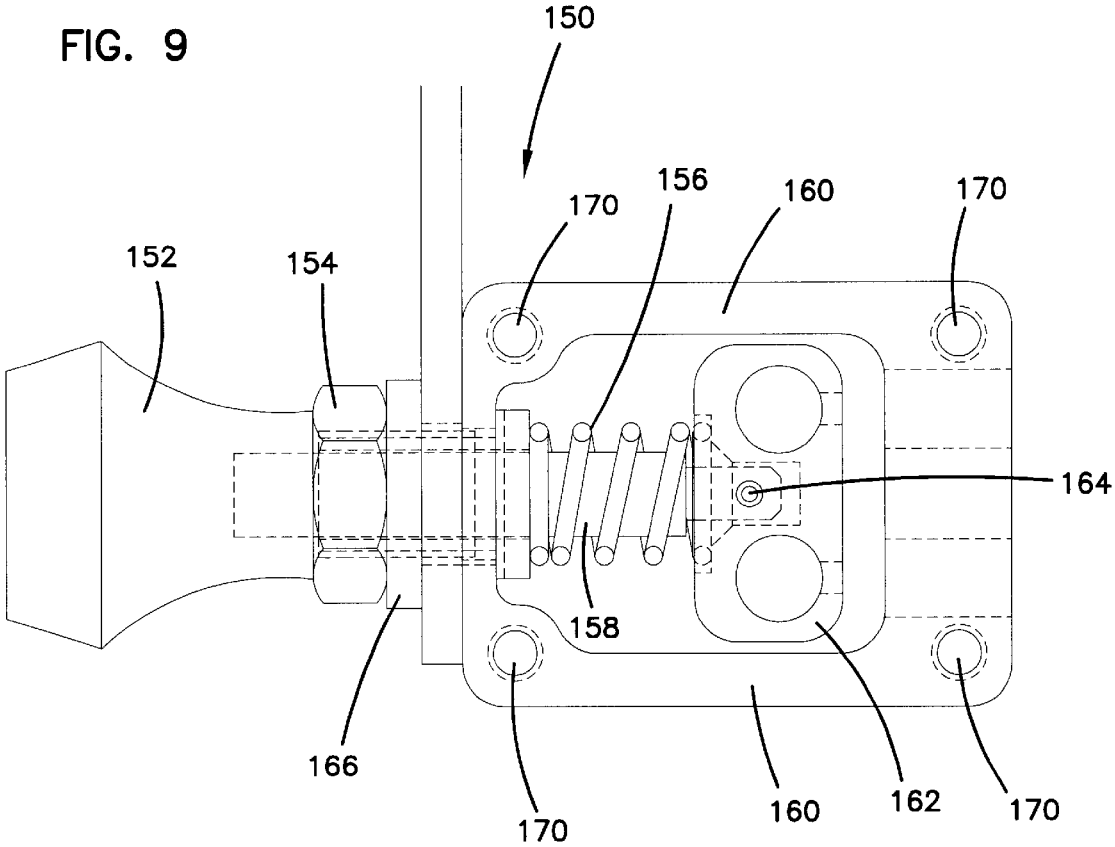
FIG. 9 shows a top plan view of an actuator for the valve shown in FIG. 6.
Figure 10:
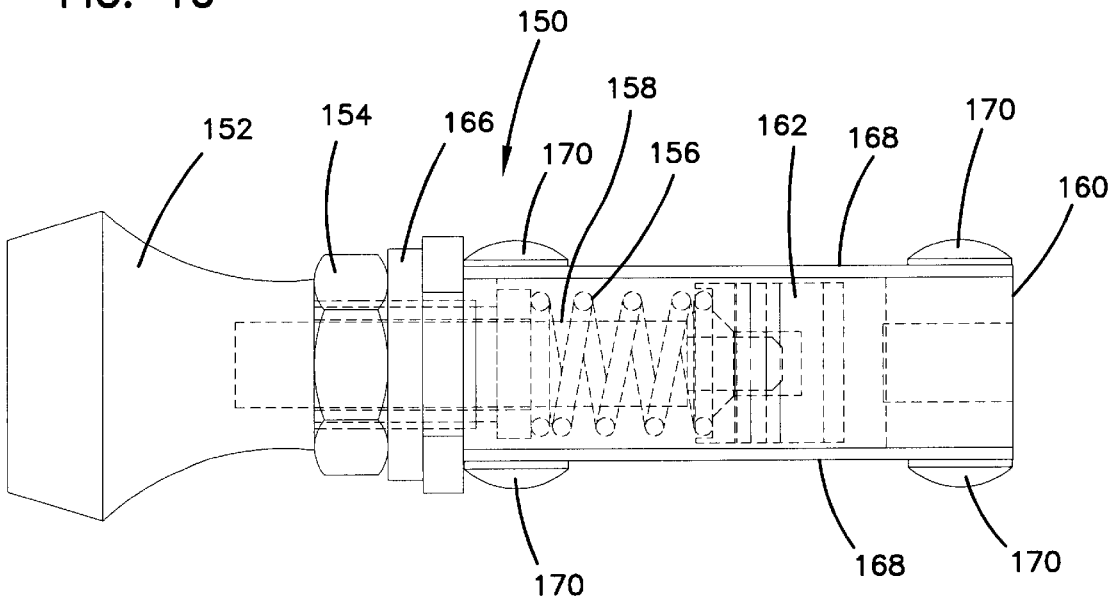
FIG. 10 shows a side elevational view of the actuator shown in FIG. 9.
Figure 11:
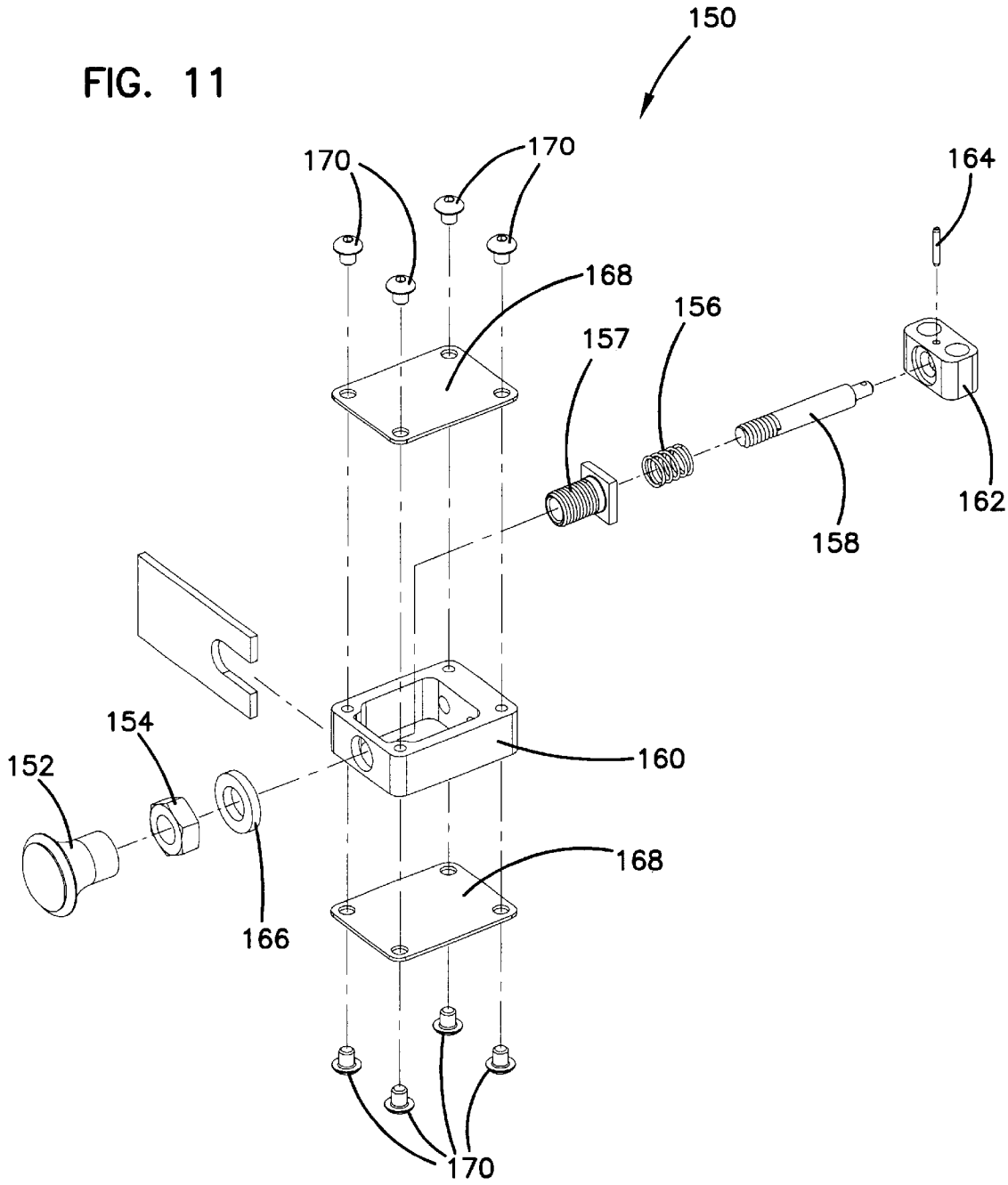
FIG. 11 shows an exploded view of the actuator shown in FIG. 9.

The release valve 100 is actuated through the cable 138 to an actuator 150, shown in FIGS. 9 and 10. The actuator 150 mounts to a bracket, such as a choke bracket or other accessible convenient location remote from the valves 100. The actuator 150 actuates the cable 138 that may be split to multiple release valves 100 corresponding to the multiple cylinders of the engine, such as the single actuation of multiple cylinders shown in FIG. 1. The actuator 150 includes a knob 152 and a nut 154 mounted to a guide 157, which extends through a slot or hole of a mounting bracket. Pulling the knob 152 manually actuates the actuator 150. A biasing spring 156 extends around shaft 158 and biases the actuator 150 toward the closed position. A block 162 slidably mounts in the housing 160 and includes a pin 164. The pin 164 extends into a hole in the shaft 158 and allows the block 162 to pivot about the pin 164, thereby maintaining substantially even tension on the cables. In an alternate embodiment, the shaft 158 mounts directly to the block 162. The block 162 includes two cable retainer cavities receiving the barrel members from the ends of two cables leading to the two valves 100. The elements are housed and retained by a washer 166, a cover 168 and screws 170. Pulling the knob 152 opens the valve 100 and moves the plunger 114 to its open position. The valves 100 are set and the spring 156 pushes the knob 152 back to its home position.

Figure 12:
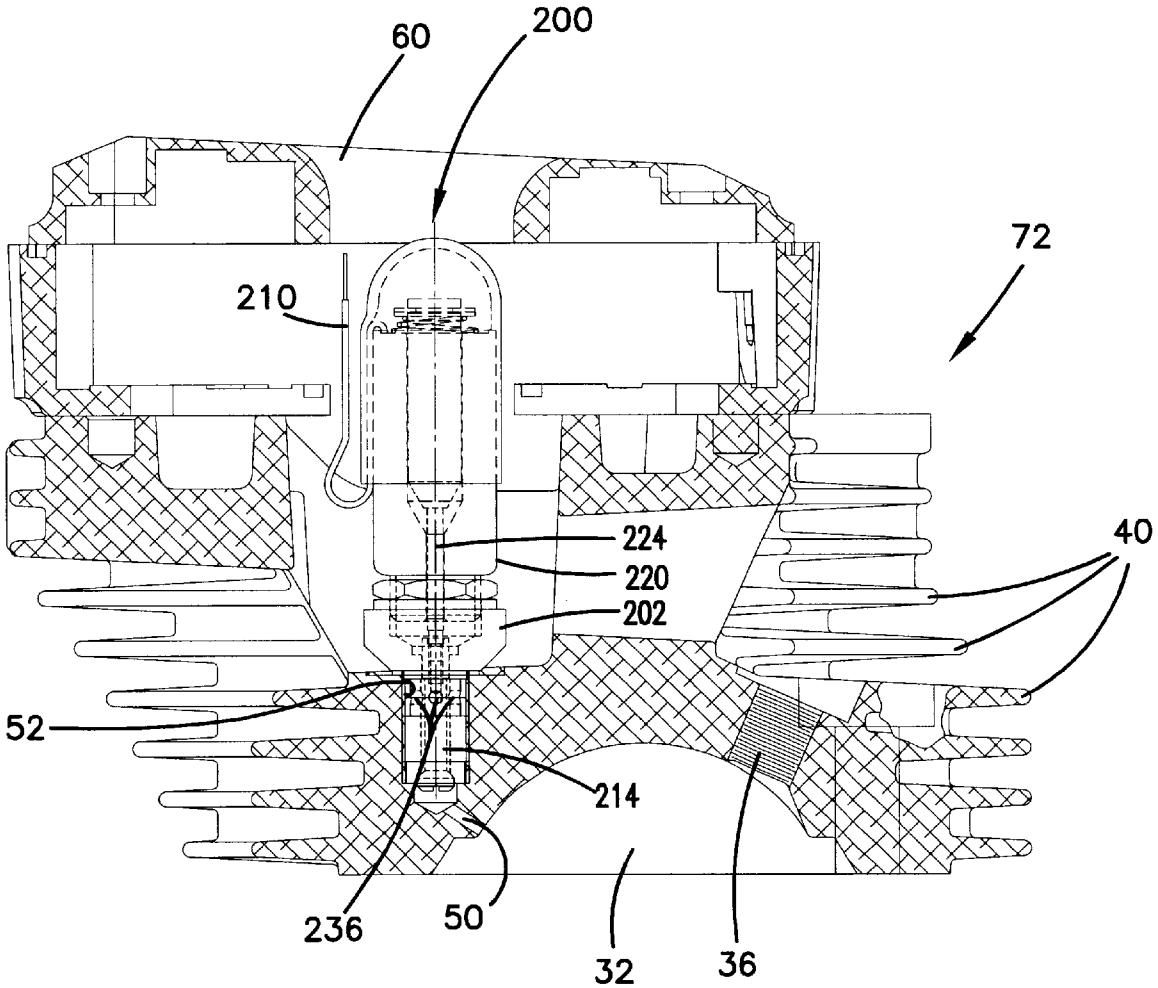
FIG. 12 shows a side sectional view of a cylinder head with a pressure release duct and the second embodiment of the release valve shown in FIG. 1, according to the principles of the present invention.
Figure 13:
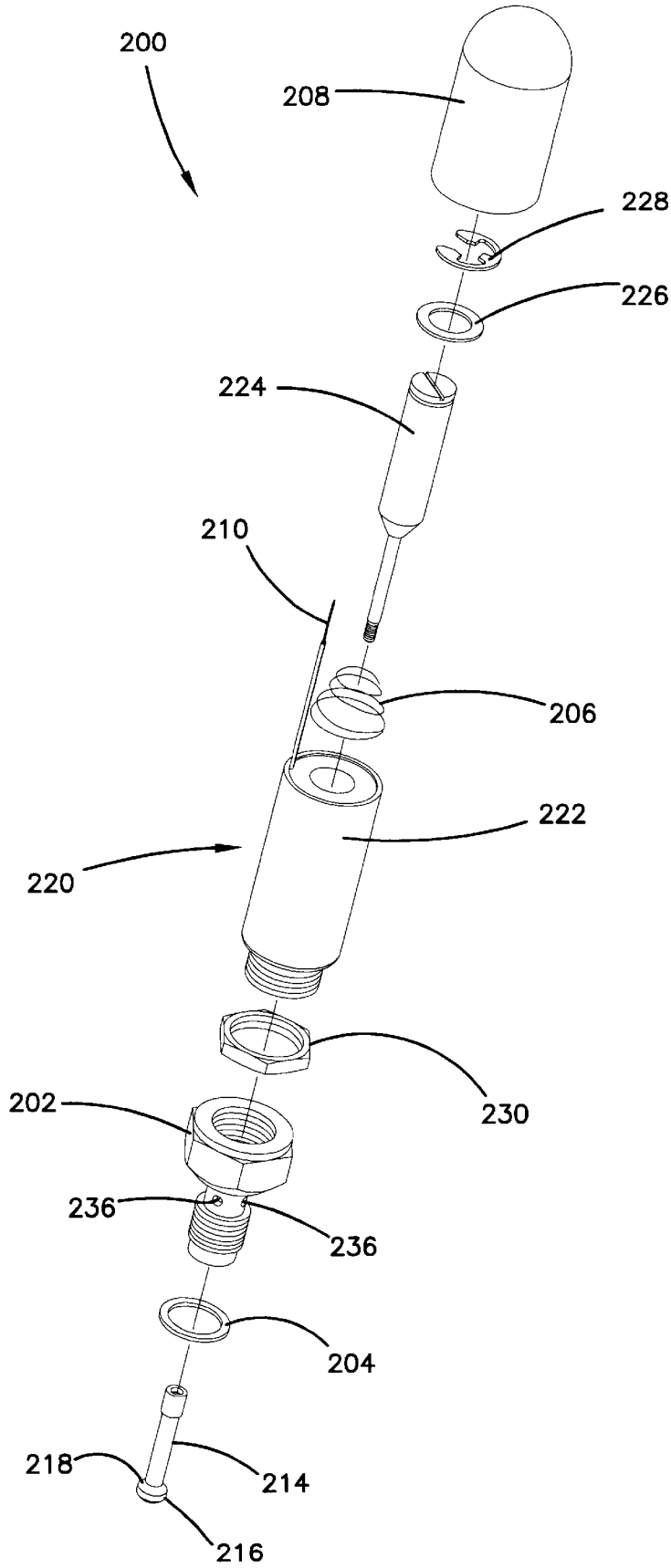
FIG. 13 shows an exploded view of the release valve shown in FIG. 12.

Referring now to FIG. 12, there is shown a second embodiment of a release valve, generally designated 200. The release valve 200 mounts in the cylinder head 22 in the valve mounting bore 52 as shown in FIGS. 1 and 2, in a manner similar to the mounting of a release valve 100. The release valve 200 is an electrically actuated valve and is actuated by an electric switch or by tying into a circuit, typically the starter circuit, through wiring 240, and actuated with an electric switch or the starter, rather than a mechanical actuator and cable. The valve 200 includes a valve body 202 with a washer 204, as shown in FIG. 13. A plunger 214 includes a head 216 and sealing surface 218, similar to the plunger 114 of the valve 100. A spring 206 biases the valve 200 toward the closed position. The solenoid assembly 220 includes a solenoid body 222, including an integrally formed coil and lead wires 210. An iron core 224 slidably mounts in the solenoid body 222 and is biased toward a closed position by the spring 206. A washer 226 and retainer clip 228 attach to the core 224 and hold the spring 206 in place. A cap 208 slides on the solenoid body 222 to prevent outside contaminants from entering the solenoid body 222. A nut 230 locks the valve body 202 to the solenoid assembly 220. The valve body 202 includes exit holes 236 similar to the exit holes 136 in the valve 100 and aligning with the end of the second relief duct 54, leading to the exhaust port 44.

Figure 14:
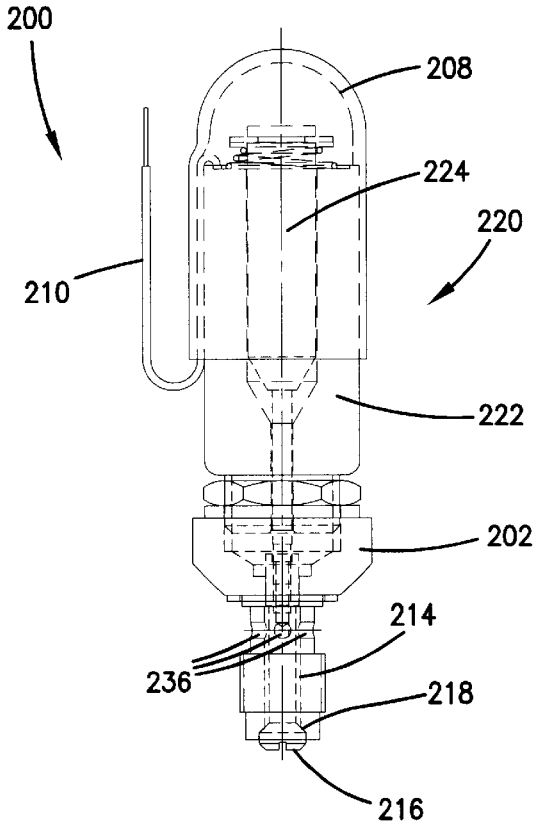
FIG. 14 shows a side elevational view of the valve shown in FIG. 12 in a closed position.
Figure 15:
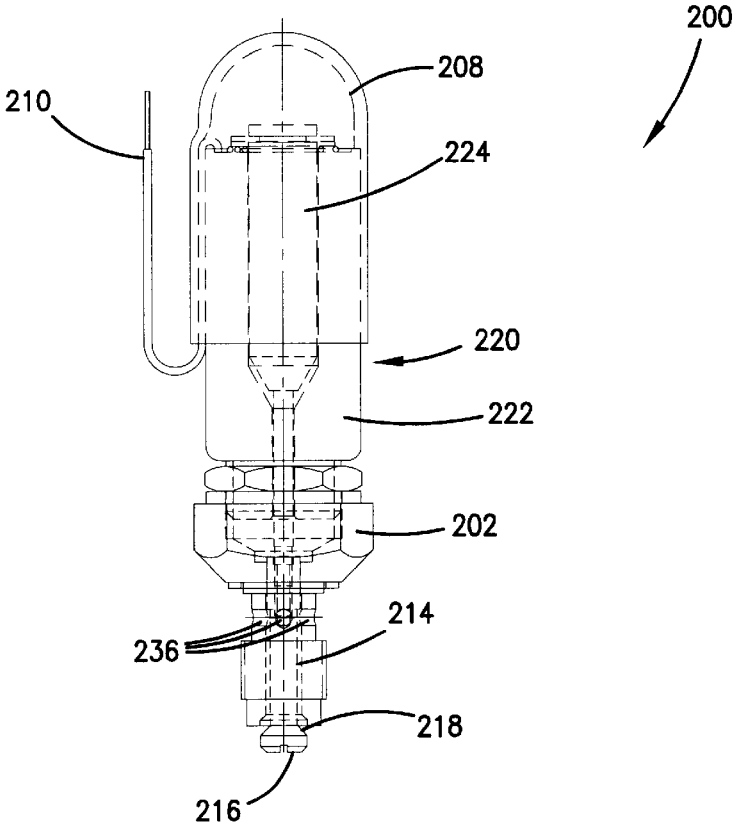
FIG. 15 shows a side elevational view of the valve shown in FIG. 12 in an open position.

As shown in FIGS. 14 and 15, the valve 200 moves between a closed position shown in FIG. 14 and an open position shown in FIG. 15. The plunger 214 moves as the solenoid 220 is energized, impelling the sliding core 224 to move from the retracted position shown in FIG. 14 to the extended position shown in FIG. 15, thereby opening the valve 200. In the closed position, the sealing surface 218 seals against the bottom of the complementary surface on the bottom of the valve body 202. In the open position shown in FIG. 15, the plunger head 216 is extended outward from the valve body 202 to allow air to pass between the plunger 214 and the valve body 202 through the exit holes 236 to reduce the compression pressure.

Referring again to FIG. 1, it can be appreciated that multiple valves 200 may be actuated from a single actuator. Wiring 240 includes splitters that are spliced and wired together so that multiple valves 200 are all actuated off the same single energization of the circuit. Cable 138 is also split in a similar manner, so that a single actuator 150 actuates all the pressure relief valves 100.

In operation, when the engine is started, the valve either 100 or 200 is open, as shown in FIGS. 5 and 12 from actuation of the actuator 150 or energization of the starter circuit. As the engine is cranked and the pistons compress air in the combustion chamber 32, pressure in the combustion chamber 32 is relieved as air vents through the first relief duct 50, passing through the valve body 102 or 202, out exit holes 136 or 236 through the second relief duct 54 to the exhaust port 44, as shown in FIG. 2. The pressure increases from approximately 200 PSI during cranking to over 500 PSI during initial start up. The increase in pressure is sufficient to overcome the resistance of the ball detents 108 in valve 100 or the resistance of solenoid 220 in valve 200 to move the plunger 114 or 214, respectively, back to the retracted position, as shown in FIGS. 7 and 14. The spring 144 or 206 keeps the pressure release valve 100 or 200 in the closed position. The gases are vented to the exhaust system through exhaust opening 44, rather than to the atmosphere.

It can be appreciate that the present invention provides a reliable system that overcomes the problems of the prior art. The system may be easily retrofitted to existing internal combustion engines. No modifications are needed for the valve train associated with each cylinder to accommodate the present invention.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A compression pressure reduction arrangement for an internal combustion engine, comprising:

a compression release valve having a housing, an inlet, an outlet, and a valve member comprising an electrically actuatable solenoid disposed in said housing that is movable between open and closed positions, said open position permitting compressed air to move through said release valve from said inlet to said outlet; and a cylinder head having a first passage connecting a combustion chamber with said inlet of said compression release valve; and a second passage connecting said outlet of said compression release valve with an exhaust system of the engine;

whereby compressed air from the combustion chamber is exhausted by said compression release valve to the exhaust system of the engine.

2. A compression pressure reduction arrangement according to claim 1, wherein said second passage is formed in said cylinder head and extends to an exhaust port of said cylinder head.

3. A compression pressure reduction arrangement according to claim 1, wherein said valve member comprises a plunger longitudinally movable within a valve body, said plunger cooperating with a seating surface to define said inlet, said valve body having an opening that comprises said outlet.

4. A compression pressure reduction arrangement according to claim 1, further comprising a starter circuit, wherein said compression release valve is electrically actuatable by energizing the starter circuit.

5. An internal combustion engine comprising a plurality of compression pressure reduction arrangements according to claim 1.

6. An internal combustion engine according to claim 5, wherein a single actuator actuates the plurality of compression pressure reduction arrangements.

7. A compression pressure release valve for an internal combustion engine, comprising:

a housing;

a valve member disposed in said housing, movable between an open position in which compressed air is released from the combustion chamber of the engine, and a closed position in which compressed air is not released;

a valve driving member movable with said valve member; and a magnetic coil surrounding said valve driving member and cooperating with said driving member to move said driving member relative to said magnetic coil when said magnetic coil is electrically energized;

said valve driving member and magnetic coil constructed and arranged such that, when said magnetic coil is energized, said valve driving member drives said valve member to said open positions;

a starter switch electrically connected to said valve, said switch providing a control signal that activates said valve when said starter switch is closed, thereby energizing said magnetic coil and moving said valve member to said open position.

8. A compression pressure release valve according to claim 7, wherein said valve driving member and said valve member are fixed with respect to one another.

9. A compression pressure release valve according to claim 7, further including a compression spring wherein, when said magnetic coil is no longer energized, said spring drives said valve member to said closed position.

10. An internal combustion engine, comprising:

a cylinder head defining a cylinder and a combustion chamber;

a compression pressure reduction arrangement, comprising:

a compression release valve having a housing, an inlet, an outlet, and a valve member comprising an electrically actuatable solenoid disposed in said housing that is movable between open and closed positions, said open position permitting compressed air to move through said release valve from said inlet to said outlet;

wherein said cylinder head defines a first passage connecting said combustion chamber with said inlet of said compression release valve; and wherein said cylinder head defines a second passage connecting said outlet of said compression release valve with an exhaust system of the engine;

whereby compressed air from the combustion chamber is exhausted by said compression release valve to the exhaust system of the engine.

11. An internal combustion engine according to claim 10, wherein said second passage is formed in said cylinder head and extends to an exhaust port of said cylinder head.

12. An internal combustion engine according to claim 10, wherein said valve member comprises a plunger longitudinally movable within a valve body, said plunger cooperating with a seating surface to define said inlet, said valve body having an opening that comprises said outlet.

13. An internal combustion engine according to claim 10, further comprising a starter circuit, wherein said compression release valve is electrically actuatable by energizing the starter circuit.

14. An internal combustion engine according to claim 10, comprising a plurality of cylinders and a plurality of associated compression pressure reduction arrangements.

15. An internal combustion engine according to claim 14, wherein a single actuator actuates the plurality of compression pressure reduction arrangements.

16. A compression pressure reduction arrangement for an internal combustion engine, comprising:

a compression release valve having a housing, an inlet, an outlet, and a valve member comprising an electrically actuatable solenoid disposed in said housing that is movable between open and closed positions, said open position permitting compressed air to move through said release valve from said inlet to said outlet; and a cylinder head having a first passage connecting a combustion chamber with said inlet of said compression release valve; and a second passage connecting said outlet of said compression release valve internally to the engine;

whereby compressed air from the combustion chamber is exhausted by said compression release valve to the engine.

17. A compression pressure reduction arrangement according to claim 16, wherein said second passage is formed in said cylinder head.

18. An internal combustion engine, comprising:

a cylinder head defining a cylinder and a combustion chamber;

a compression pressure reduction arrangement, comprising:

a compression release valve having a housing, an inlet, an outlet, and a valve member comprising an electrically actuatable solenoid disposed in said housing that is movable between open and closed positions, said open position permitting compressed air to move through said release valve from said inlet to said outlet;

wherein said cylinder head defines a first passage connecting said combustion chamber with said inlet of said compression release valve; and wherein said cylinder head defines a second passage connecting said outlet of said compression release valve internally to the engine;

whereby compressed air from the combustion chamber is exhausted by said compression release valve to the engine.

19. A compression pressure reduction arrangement for an internal combustion engine, comprising:

an electrically actuatable compression release valve having a housing, an inlet, an outlet, and a valve member disposed in said housing that is movable between open and closed positions, said open position permitting compressed air to move through said release valve from said inlet to said outlet, wherein the valve opens by electrical actuation and automatically closes from increased engine pressure; and a cylinder head having a first passage connecting a combustion chamber with said inlet of said compression release valve; and a second passage connecting said outlet of said compression release valve internally to the engine;

whereby compressed air from the combustion chamber is exhausted by said compression release valve to the engine.

20. An internal combustion engine according to claim 19, further comprising a starter switch electrically connected to said valve, said switch providing a control signal that opens said valve when said starter switch is closed.

21. An internal combustion engine, comprising:

a cylinder head defining a cylinder and a combustion chamber;

a compression pressure reduction arrangement, comprising:

a compression release valve having a housing, an inlet, an outlet, and a valve member disposed in said housing that is movable between open and closed positions, said open position permitting compressed air to move through said release valve from said inlet to said outlet, wherein the valve opens by electrical actuation and automatically closes from increased engine pressure;

wherein said cylinder head defines a first passage connecting said combustion chamber with said inlet of said compression release valve; and wherein said cylinder head defines a second passage connecting said outlet of said compression release valve internally to the engine;

whereby compressed air from the combustion chamber is exhausted by said compression release valve to the engine.

22. An internal combustion engine according to claim 21, further comprising a starter switch electrically connected to said valve, said switch providing a control signal that opens said valve when said starter switch is closed.

* * * * *

UNITED STATES PATENT AND TRADEMARK OFFICE

CERTIFICATE OF CORRECTION

PATENT NO. : 6,557,510 B2
DATED : May 6, 2003
INVENTOR(S) : Sjovall et al.

It is certified that error appears in the above-identified patent and that said Letters Patent is hereby corrected as shown below:

Title page,
Item [56], References Cited, U.S. PATENT DOCUMENTS, "Holtemann" should read -- Holtermann --

Signed and Sealed this

Twenty-first Day of October, 2003

JAMES E. ROGAN
*Director of the United States Patent and Trademark Office*